US005655246A

United States Patent [19]

Chang

[11] Patent Number: 5,655,246

[45] Date of Patent: Aug. 12, 1997

[54] PULSATING SUBMERSIBLE POOL CLEANER

[76] Inventor: Paul C. Chang, 1525 N. Potomac St., Placentia, Calif. 92670

[21] Appl. No.: 635,596

[22] Filed: Apr. 22, 1996

[51] Int. Cl.[6] ..... E04H 4/16

[52] U.S. Cl. ..... 15/1.7

[58] Field of Search ..... 15/1.7

[56] References Cited

U.S. PATENT DOCUMENTS

| | | | |
|---|---|---|---|
| 4,023,227 | 5/1977 | Chauvier | 15/1.7 |
| 4,133,068 | 1/1979 | Hofmann | 15/1.7 |
| 4,208,752 | 6/1980 | Hofmann | 15/1.7 |
| 4,351,077 | 9/1982 | Hofmann | 15/1.7 |
| 4,642,833 | 2/1987 | Stoltz et al. | 15/1.7 |
| 4,742,593 | 5/1988 | Kallenbach | 15/1.7 |
| 4,761,848 | 8/1988 | Hofmann | 15/1.7 |
| 4,769,867 | 9/1988 | Stoltz | 15/1.7 |
| 4,807,318 | 2/1989 | Kallenbach | 15/1.7 |
| 4,817,225 | 4/1989 | Stoltz | 15/1.7 |
| 4,949,419 | 8/1990 | Kallenbach | 15/246 |
| 5,014,382 | 5/1991 | Kallenbach | 15/1.7 |
| 5,033,148 | 7/1991 | Chauvier et al. | 15/1.7 |
| 5,265,297 | 11/1993 | Gould et al. | 15/1.7 |
| 5,301,380 | 4/1994 | Wadman et al. | 15/1.7 |
| 5,315,728 | 5/1994 | Atkins | 15/1.7 |
| 5,337,433 | 8/1994 | Gould et al. | 15/1.7 |
| 5,384,928 | 1/1995 | Khoury | 15/1.7 |
| 5,450,645 | 9/1995 | Atkins | 15/1.7 |

FOREIGN PATENT DOCUMENTS

| | | | |
|---|---|---|---|
| 2604351 | 4/1988 | France | 15/1.7 |
| 2172195 | 9/1986 | United Kingdom | 15/1.7 |

OTHER PUBLICATIONS

Jandy Industries Jandy Vac installation sheets.

*Primary Examiner*—Mark Spisich

*Attorney, Agent, or Firm*—Gordon K. Anderson

[57] ABSTRACT

A pulsating submergible pool cleaner which has a hollow body (24) connected to a pool pump through a flexible hose. An integrated reed valve (42) and relief valve (44) receive the full flow of water from the pump, with the reed valve closing, forcing the relief valve open generating hydraulic cyclic pulsations. An inlet mounting foot (74) is attached to the hollow body and a flexible circular debris removing disc (80) is removably connected to the foot. The foot and disc engage the submerged surface by the suction of the pool pump, and the cleaner is propelled around the pool surfaces by the cyclic pulsation generated by the integrated valves. Debris is removed and ingested into the cleaner by the scrubbing action of the disc, combined with high velocity water flow entering the body under the disc through small passageways. A leaf catching net (96) may be added as an accessory for collecting large debris, such as leaves of plants.

20 Claims, 4 Drawing Sheets

PULSATING SUBMERSIBLE POOL CLEANER

TECHNICAL FIELD

The present invention relates to submersible pool cleaners in general. More specifically to cleaners that are attached to the suction side of a pool pump with a hose and are self-propelled by an integral valve pulsating the water flow.

BACKGROUND ART

Previously, many types of pool cleaners have been used in endeavoring to provide an effective means for producing a momentary interruption of the pool pump intake flow to propel a cleaner around the bottom of a swimming pool, while automatically removing debris and foreign matter by the suction of the pool pump.

Prior art is replete with structure utilizing valves that cause the interruption of induced flow due to kinetic energy of the water flow transferring force to the valve using the inertia of the fluid, which in turn, promotes linear movement of the cleaner through pulsation. Various types of valves have been employed in the past for this function, which include flappers, flexible diaphragms, flexible jaws, bellows, ball type, and elastomeric jaws. In any event, these devices developed by prior art all use the suction flow created by conventional swimming pool filtration equipment. Water flow under negative pressure is intermittently interrupted by the above mentioned valve mechanism resulting in a step-like movement of the cleaner in a random fashion across the bottom and sides of swimming pool surfaces.

A search of the prior art did not disclose any patents that read directly on the claims of the instant invention, however, the following U.S. patents are considered related:

| Patent No. | Inventor | Issue Date |
|---|---|---|
| 4,023,227 | Chauvier | May 17, 1977 |
| 4,351,077 | Hofmann | Sep. 28, 1982 |
| 4,642,833 | Stoltz et al | Feb. 17, 1987 |
| 4,742,593 | Kallenbach | May 10, 1988 |
| 4,761,848 | Hofmann | Aug. 9, 1988 |
| 4,769,867 | Stoltz | Sep. 13, 1988 |
| 4,807,318 | Kallenbach | Feb. 28, 1989 |
| 4,817,225 | Stoltz | Apr. 4, 1989 |
| 4,949,419 | Kallenbach | Aug. 21, 1990 |
| 5,014,382 | Kallenbach | May 14, 1991 |
| 5,033,148 | Chauvier et al | Jul. 23, 1991 |
| 5,265,297 | Gould et al | Nov. 30, 1993 |
| 5,315,728 | Atkins | May 31, 1994 |
| 5,337,433 | Gould et al | Aug. 16, 1994 |
| 5,384,928 | Khoury | Jan. 31, 1995 |
| 5,440,645 | Atkins | Sep. 19, 1995 |

U.S. Pat. Nos. 4,023,227, 4,351,077 and 5,033,148 teach a flapper valve that is pivotally displaced to automatically transfer flow from one passage to another. In some cases a bypass valve is required to regulate the suction pressure applied to the apparatus and in '148 an auxiliary inlet is utilized to accommodate the volume of fluid flow through the pool pump.

A flexible diaphragm valve is utilized in U.S. Pat. Nos. 4,642,833, 4,742,593, 4,761,848, 5,315,728 and 5,450,645 which consists of a resilient tube that is reduced in cross-section in the middle, with external or internal ribs for controlling it's flexibility. In all cases, the diaphragm is closed due to the negative pressure of the pump overcoming the resistance of the flexural walls pulling the walls together to impede the flow. Pressure equalization on the outside of the diaphragm permits opening, and various methods are employed to accomplish this function, such as spring loading, etc.

U.S. Pat. Nos. 4,769,867, 5,265,297 and 5,384,928 disclose a valve having jaw-like lips of a flexible material biased in an open position by it's inherent elasticity and resiliency. The lips close under negative pressure and reopen by the material establishing it's inherent memory.

The physical characteristics of the flexible disc and stop arrangement are presented in U.S. Pat. Nos. 4,949,419 and 5,014,382 for background purposes.

Kallenbach in U.S. Pat. No. 4,807,318 employs a spring loaded bellows-like diaphragm and a rigid unrestricted outlet passageway for flow interruption and cycling.

A spherical closure member having a specific gravity slightly greater than the liquid causes interruption by moving freely toward and away from the valve seat in U.S. Pat. No. 4,817,225.

U.S. Pat. No. 5,337,433 is the prior art upon which the instant invention is an improvement. Gould et al teach a valve having an entrance mouth with one or more single acting closure lips formed of thin metal spring material. The lips are drawn into full closure by the suction of the pool pump and open when the bias is substantially less than the closing force. No bumpers, weights, nets, or floats are used to assist in balance efficiency. Partial flow of the pump is utilized in the apparatus at a specific design flow rate.

DISCLOSURE OF THE INVENTION

While the use of self-propelled cleaning devices for private swimming pools has been widely accepted, there are limitations which detract from its overall capabilities. In the first place, the main problem in most devices is the restrictive water flow rate in which the flow must be regulated to a specific volume in order for the valve to function properly. As an example of this limitation, the commercially available so-called JANDY VAC pool cleaner manufactured by Jandy Industries of Novato, Calif., protected by U.S. Pat. Nos. 5,265,297 and 5,337,433 requires a specific flow of 22 gallons per minute (1.4 L/S) to start, forcing the mouth or valve to close for the first time, and 14 gallons per minute (0.88 L/S) to continue operation. In order to adjust the flow rate, a regulating device in the form of a bypass flow regulating valve must be added that limits the flow to the cleaner and bypasses the balance of the pumps capabilities. This means that only a small portion of the pump's potential may be utilized, as an example, most pumps handle from 60 to 80 gallons per minute (3.8 to 5 L/S) total flow at the pressure resistance found in typical piping arrangements and filter system restrictions. In this instance 22–14 gallons per minute (1.4 to 0.88 L/S) are used for cleaning and the balance of from 38 to 66 gallons per minute (2.4 to 4.2 L/S) are bypassed and completely wasted.

Improvements in a novel and unique valve arrangement overcome this problem and, therefore, become a primary object of the invention. This arrangement permits the full flow of the pump to enter the cleaner and an integral double acting reed valve and combined spring loaded relief valve function to shut-off the flow, which then immediately opens the relief valve effectively providing the hydraulic cycling action to propel the apparatus while still permitting the full flow to accomplish the cleaning tasks. It may immediately be seen that the improvement provides the necessary movement by pressure cycling, used extensively by prior art without the need of special diverters or bypass valves simplifying installation and reducing costs. This improvement may be used on pools that are made of gunite, fiberglass, or using a polyvinyl liner and the overall efficiency of the system is improved by from 60 to 75 percent.

An important object of the invention overcomes other problems inherent in the bypass system and narrow flow range of operation required by prior art. In the past, the pool cleaner may become stuck in the shut position if the flow rate exceeds the limitations or stays open if low flow conditions occur. These aberrations may develop if the water level in the filter tank becomes low and, further, many times a differential of 2 or 3 gallons per minute (0.13 or 0.19 L/S) may exist on initial start-up, and last up to 2 or 3 minutes due to an empty tank, or if the level has been decreased by a lapsed time interval of operation.

Another object of the invention is that the improvement is unaffected by local power characteristics. During peak periods when electrical usage is at its greatest, such as summertime, when the use of fans along with residential and commercial air conditioning is maximized, the line voltage from the network is reduced, which in turn causes the filter pump to operate at a slightly lower speed. As the speed of a pump is basically proportional to its flow, this reduction may inadvertently cause the cleaner valve to become inoperative and cease to be propelled. This condition may cause the cleaner to rub against the pool wall in one place and in vinyl lined pools this continuous rubbing action often causes sufficient wear in one spot as to eventually abrade the material until it wears a hole resulting in a leak. While other pool materials are not as susceptible to leakage, a worn spot may later attract the cleaner and cause more wear when the device is returned to its normal operation, even to the extent it will become stuck in the abraded spot and fail to clean the balance of the pool.

Still another object of the invention is the life expectancy of the valve arrangement. In the past, reed valves have been employed that bend over a single arc and have the tendency to fatigue at the critical bend. This constant occelation in operation develops a hairline crack and finally yields and breaks, discontinuing operation of the entire cleaner. The improvement utilizes a double acting reed valve that has less of an arc, as two sections work in concert changing the attachment point and consequently the arc of contact with the fulcrum is lessened prolonging the life of the valve. Further, a simple spring loaded relief valve is also utilized, well known for its long life and reliability.

Yet another object of the invention is the use of a unitary removable valve assembly that contains both valves in a single form. The one-piece assembly may be removed and replaced as a complete unit, or individual valves may have working components replaced easily. Each dual acting reed is mounted on a stud with a keyhole slot, therefore, by simply sliding the valve reed upward it is easily removed. The relief valve seal disc and spring are removed by rotating a threaded spring retainer and slipping them off over the body. Further, with this arrangement the cyclic pulsation of the cleaner is easily adjusted by changing tension on the spring simply loosening or tightening the spring retainer. If the frequency of the cyclic pulsation is too slow, say lower than 4 cycles per second, it will not move or moves so leisurely that the pool is not completely cleaned and, if over 6 cycles per second, it will not pick-up the dirt and debris properly, whereas the improved cleaner is less frequency sensitive and may be easily adjusted without tools to the optimum cyclic speed.

A further object of the invention is directed to the use of scrapers and brushes on an offset forward portion of the flexible circular disc. As the front half of the disc is offset upwardly away from the pool surface and a number of scrapers extend downwardly to maintain this clearance, almost all of the water flow passes over this area at a high velocity causing an efficient cleaning action, further, the brushes scrub the surface loosening particles that have adhered to the surface, thus providing a highly effective cleaning action.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
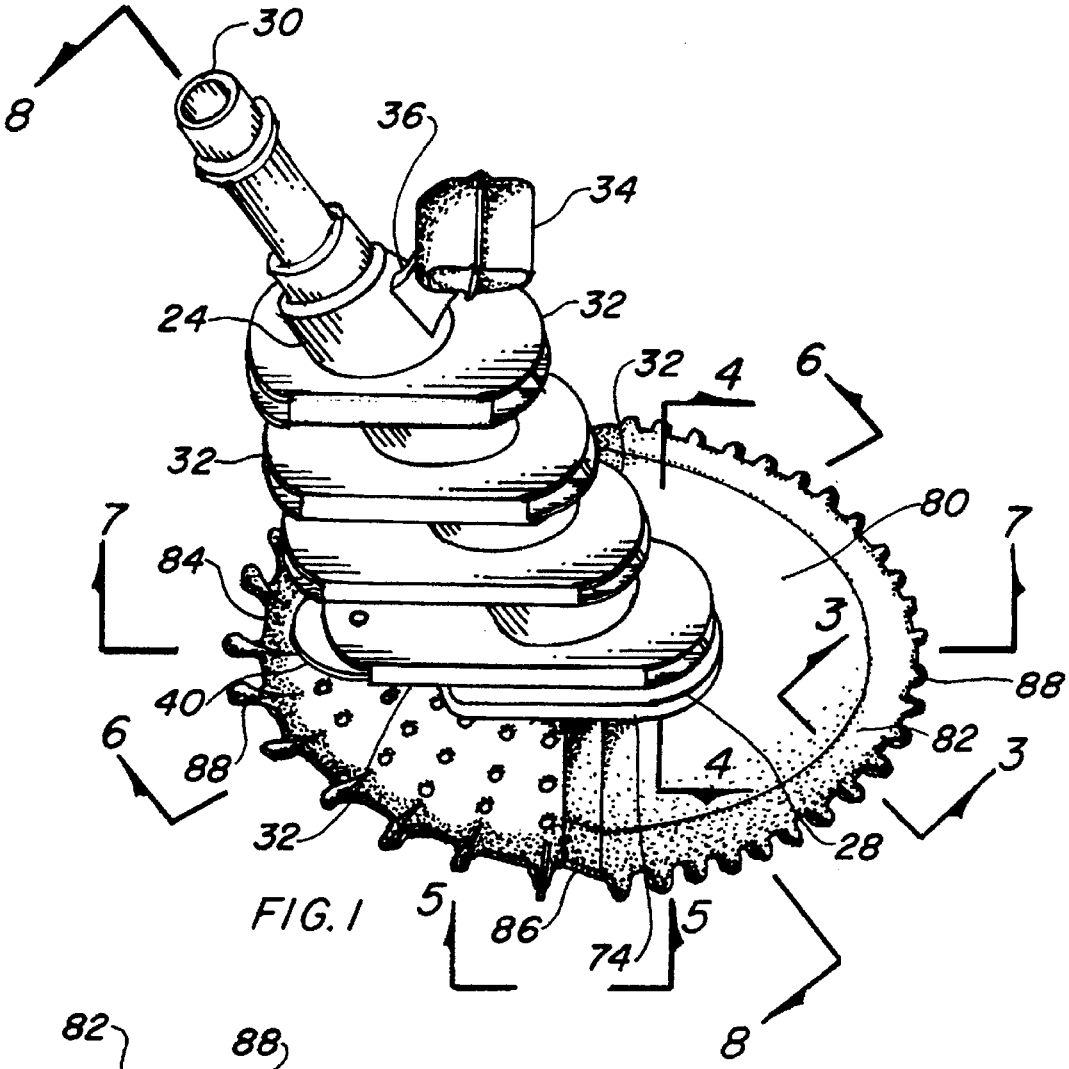
FIG. 1 is a partial isometric view of the preferred embodiment.
Figure 3:
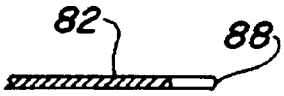
FIG. 3 is a cross-sectional view taken along lines 3—3 of FIG. 1.

The best mode for carrying out the invention is presented in terms of a preferred embodiment.

The preferred embodiment, as shown in FIGS. 1 through 23, is comprised of a hollow body 24 having a water flow passageway 26 therethrough connected to a pool pump in a pool filtration system through a flexible hose. The body 24 has a bottom flange 28 with an inlet in the center and a top outlet 30 that contains means for hose attachment. The body also includes a number of outwardly extending peripheral bumpers 32, that create stability to the pool cleaner and act as protection from blockage and upending when colliding with obstacles that may be in the pool. These bumpers 32 protrude in planar alignment with the bottom flange 28 and may be any shape, however, hollow is preferred, as illustrated in FIGS. 1, 4, 7, and 20. These bumpers 32 extend somewhat beyond the body 24 exterior front and back and are in direct alignment with each other. The hollow configuration and precise location provide both directive characteristics and water flow passages for added stability while the cleaner is in operation.

Figure 19:
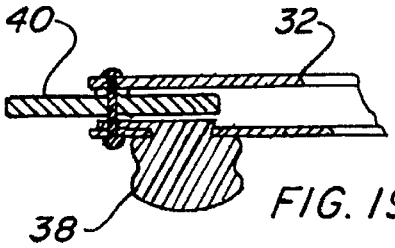
FIG. 19 is a cross-sectional view taken along lines 19—19 of FIG. 18.
Figure 20:
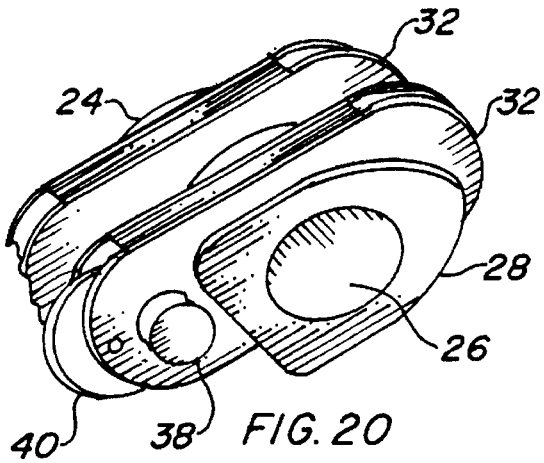
FIG. 20 is a partial isometric view of the body illustrating the means for attachment to the mounting foot completely removed from the invention for clarity.
Figure 21:
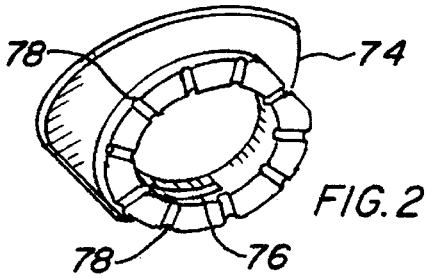
FIG. 21 is a partial isometric view of the mounting foot completely removed from the invention for clarity.

A float 34 in the form of a hollow air filled chamber is attached to the body 24 with a mounting arm 36 adjacent to the top outlet 30 for providing positive and automatic uprighting in the event the cleaner is inadvertently turned upside down. A weight 38 is preferably attached beneath the lowest bumper 32, as depicted in FIG. 19, for stability of the cleaner when it is propelled on pool submerged surfaces. This weight 38 consists of cast lead, or some other heavy metallic substance. A bumper wheel 40 is rotatably disposed within the lowest forward bumper 32, as shown separately in FIG. 18 and in the invention in FIGS. 1 and 8. This wheel 40 extends beyond the end of the bumper 32 and is rotatably attached with a threaded fastener, rivet, axle, or the like. The rotatable action provides continued mobility for the cleaner in the event it strikes a fixed obstruction on the pool submerged surface, such as a step or steep wall. The body 24, including the bumpers 32 and wheel 40, are preferably made of a thermoplastic material, such as polycarbonate, polyethylene, polyvinyl chloride, polystyrene, polyurethane, ABS, phenolic, or the like. The construction techniques include injection molding in a unitary arrangement, or in combined pieces, including extrusions attached together by adhesive or heat activated welding.

The propulsion and cleaning operation is provided by full flow valve means located entirely within the hollow body water flow passageway 26. This functional operation receives the full and complete flow of water from the pool's filtration pump. In operation, the water flow is shut off on the pump's suction side by the valve means and then subsequently opening a separate relief or bypass portion of the valve means maintaining an unimpeded flow of water and, yet, secondarily producing a hydraulic cyclic pulsation action without actually blocking the flow of water to the pump. This hydraulic action, or so-called water hammer, occurs instantaneously when the valve means are completely closed, however, this reaction is immediately counteracted by an opening of the relief portion, thus a cyclic action or pulsation is created without restricting the flow.

Figure 11:
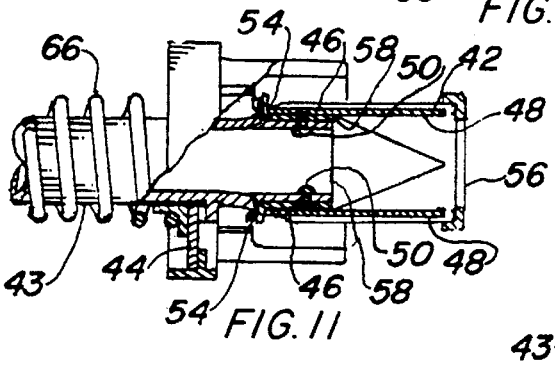
FIG. 11 is a partial view of the left side of the double acting reed valve in the open position.
Figure 12:
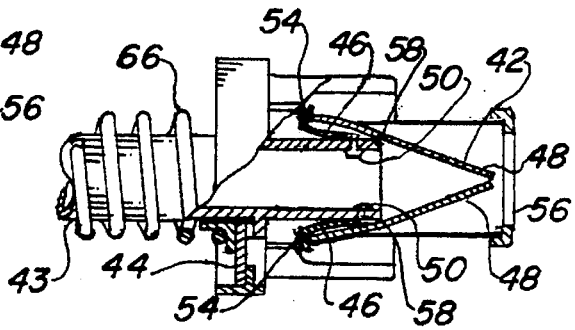
FIG. 12 is a partial view of the left side of the double acting reed valve in the closed position.
Figure 13:
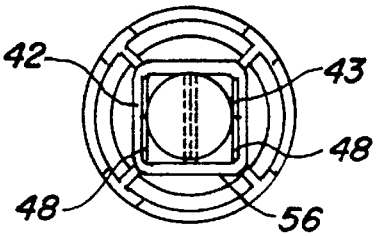
FIG. 13 is a bottom end left side of the reed valve as viewed along lines 13—13 of FIG. 9.
Figure 14:
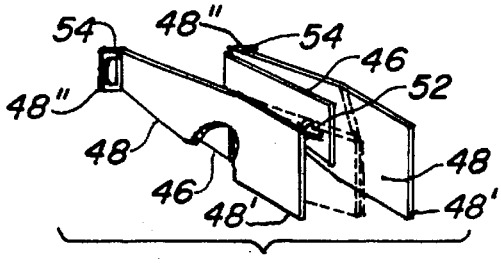
FIG. 14 is a fragmentary exploded partial isometric view of the double acting reed assembly completely removed from the invention for clarity.

The full flow valve means consists of an integrated full flow reed valve 42 and a full flow relief valve 44, each positioned entirely within the passageway 26 of the body 24. Each valve 42 and 44 is capable of receiving the full flow of water under negative pressure from the pool pump. The reed valve 42 consists of a pair of opposed deflecting reeds, each in the form of a fixed reed 46 and a movable reed 48, with the movable reed described as having a first end 48' and a second end 48". The fixed reed 46 is attached to a rigid member of the valve body 43 on one end with a stud 50 that is spaced away from the valve and the reed 50 contains a keyhole slot 52, as shown in FIG. 14, through which the stud 50 penetrates in a gripping manner when slid into the narrow portion of the slot 52. The end opposite the keyhole slot 52 is bent outward and contains an elongated slot 54 tangent with the bend. The second end 48" of the movable reed 48 is likewise bent outwardly at a right angle and penetrates the elongated slot 54 in the fixed reed 46, as depicted in FIG. 14. The first end 48' of the movable reed 48 is secured by a retainer 56 affixed to the valve 42, as illustrated in FIGS. 11 and 12, therefore, the valve reeds 46 and 48 are juxtapositioned with each other. The movable reed 48 is longer than the fixed reed 46 and extends over a fulcrum 58 on the valve body 43 and the unsupported end is exposed to negative pressure from the pool pump intake. As the two sets of reeds are positioned parallel with each other, as shown in FIGS. 11 and 14, pump suction draws each reed 48 together over the fulcrum 58, as illustrated in FIGS. 12 and 13, until they contiguously abut. The second end 48" of the valve 48, being held by the elongated slot 54, moves in opposite direction as the first end 48', however, the spring action of the fixed reed 46 is also utilized moving away from the valve body 43 creating a double action movement flexing the reeds 46 and 48 into a bow shape simultaneously, therefore, the pair of opposed reed assemblies, as shown in FIG. 14, are double acting by virtue of their combined spring action.

When the first end 48' of each movable reed 48 touch, the flow of water into the pump is blocked and a shock wave is conducted throughout the entire cleaner. This phenomenon is sometimes described as a water hammer, as previously mentioned. The instant the flow is impeded by the reed valve 42, the integral relief valve 44 sees this full negative pressure and is immediately opened permitting the full flow to continue through the water flow passageway 26. The relief valve 44 is spring loaded and consists of a valve seat 60 formed into a cage 62 integral with the valve body 43. A seal disc 64 is in linear alignment with the seat 60 and a compression spring 66 urges the seal disc 64 against the seat 60. A threaded spring keeper 68 holds the spring 66 in compressive tension, which is adjustable by rotating the keeper 68 over a set of threads 70 formed into the valve body 43. The tension on the spring 66 is adjusted to be just slightly higher than the normal pressure differential of the reed valve 42, such that it will not open until the reeds 48 in the valve 42 are completely closed.

Figure 9:
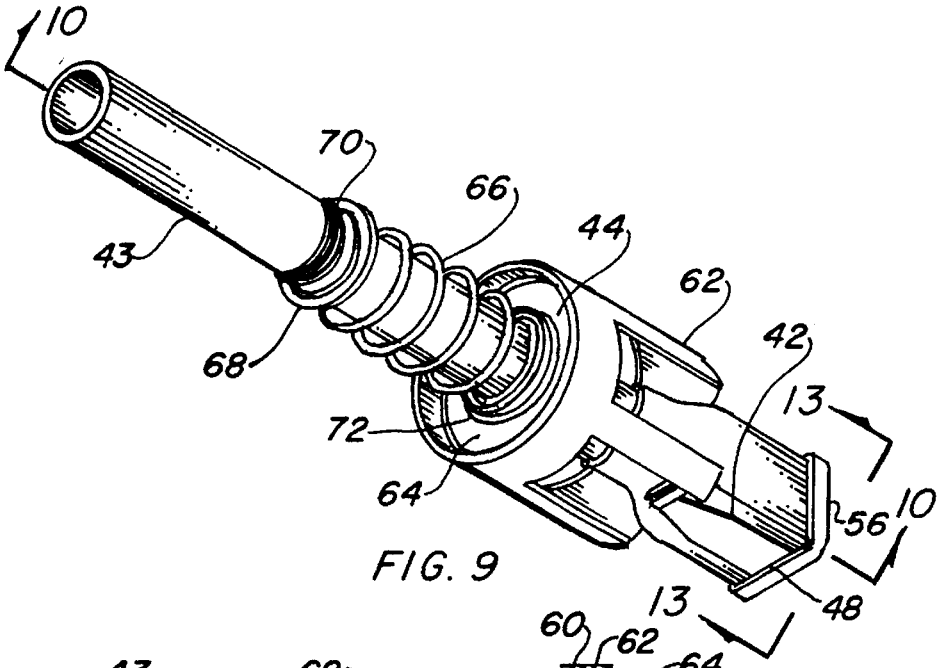
FIG. 9 is a partial isometric view of the integrated valve completely removed from the invention for clarity.
Figure 10:
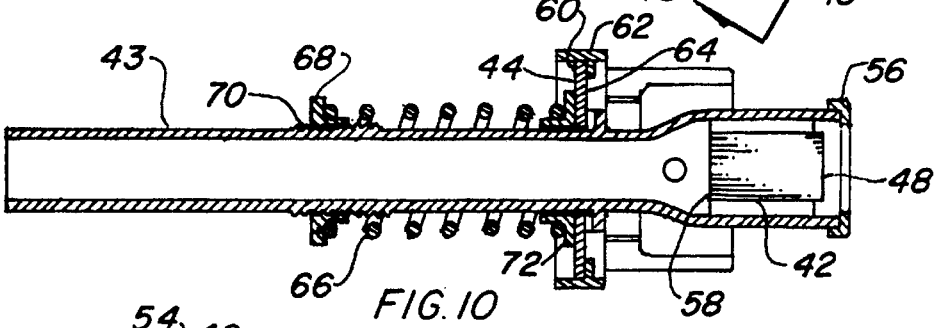
FIG. 10 is a cross-sectional view taken along lines 10—10 of FIG. 9.
Figure 15:
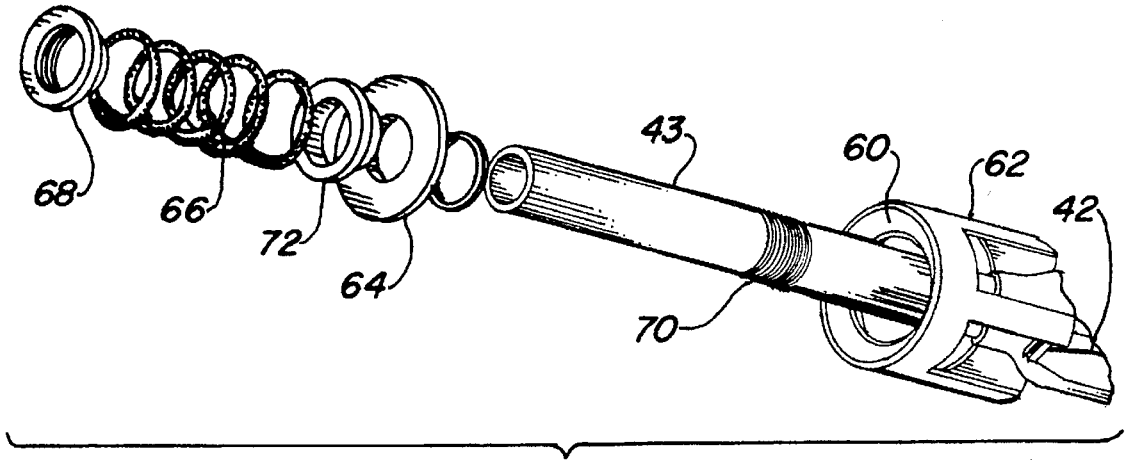
FIG. 15 is a fragmentary exploded partial isometric view of the full flow spring loaded relief valve completely removed from the invention for clarity.
Figure 16:
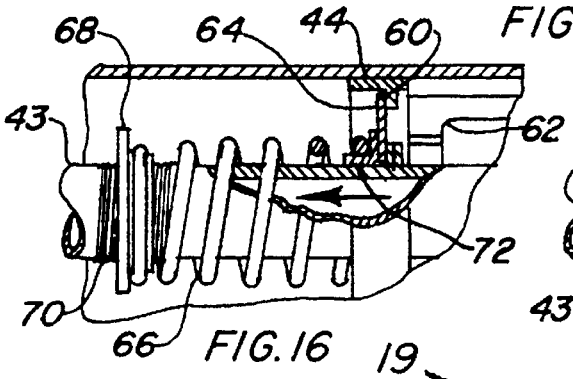
FIG. 16 is a left side view of the relief valve cut-away to illustrate the valve in the closed position.
Figure 17:
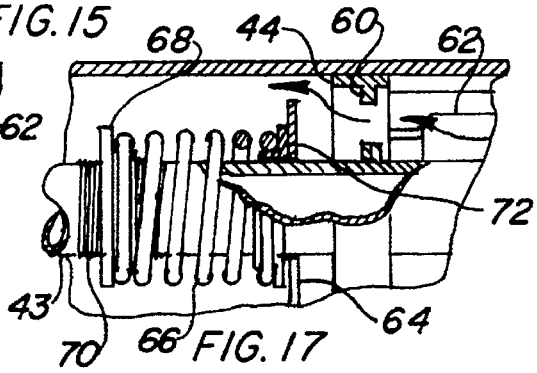
FIG. 17 is a left side view of the relief valve cut-away to illustrate the valve in the open position.
Figure 18:
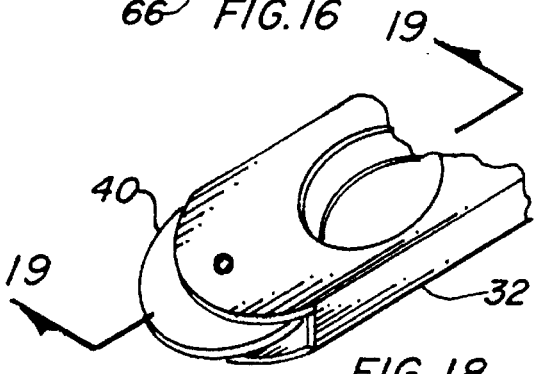
FIG. 18 is a fragmentary partial isometric view of the lowermost bumper depicting the bumper wheel and it's attachment.

FIGS. 9, 10, and 15 through 17 illustrate the relief valve 44 in it's basic form with FIGS. 9 and 10 showing it's integral arrangement with the valve body 43 and the reed valve 42. FIG. 15 depicts the valve in an exploded view with the body 43 interruptedly deleted for clarity. FIG. 16 illustrates the valve 44 in the closed position with an arrow showing it's flow direction through the reed valve 42. FIG. 17 is basically the same as FIG. 16, except the valve 42 is closed and the flow is directed through the cage 62 into the open area between the valve body 43 and the water flow passageway 26 of the hollow body 24. A valve seal disc bushing 72 interfaces between the spring 66 and the seal disc 64, centering the spring 66 and forming a flat mating surface for the seal disc 64, if desired. The cage 62 may be formed integrally with the valve body 43 or may be fabricated separately and permanently bonded in place with structural adhesive, or the like. While four openings are illustrated in the cage 62, any number of openings may be formed and will function with equal ease. Both valves 42 and 44 are fabricated of the same material as the hollow body 24, with the exception of the spring 66, which is stainless steel or electroplated spring steel, also the fixed and movable reed 46 and 48 are preferably tempered and polished stainless spring steel.

An inlet mounting foot 74 is attached beneath the hollow body 24 directly to the bottom flange 28. The foot 74 is made of a resilient material that locks onto the flange 28 in a removable but gripping manner. The foot 74 acts as a spacer between the hollow body 24 and the immersed surface of the pool and has an intake hole 76 and a number of grooves 78 in the bottom flat surface to permit water to be drawn through the hole 76 and into the water flow passageway 26 of the hollow body 24. The grooves 78 extend outwardly from the hole 76 in the center and are opposed but planar to the body bottom flange 28 also containing a mating inlet opening. This arrangement not only permits controlled water flow, but prevents the cleaner from being stuck to the pool surface and becoming inoperative. This foot 74 is illustrated as assembled in FIGS. 1, 7, and 8, and by itself in FIG. 21.

Debris removing disc means in the form of a flexible circular disc 80 is mounted onto the hollow body 24 through the mounting foot 74 in a detachable manner using it's inherent structural resiliency for a compression fit. While the disc 80 is basically round, it has a flat rear portion 82 and a raised front portion 84 with an offset 86 inbetween, such that only the rear portion 82 directly engages the pool submerged surfaces. The entire periphery includes a plurality of radial protrusions 88, as shown in FIG. 1, that add flexibility to the outer edge. On the front portion 84, the protrusions 88 are reinforced with a raised rib 90 to stiffen the structure. While any number of protrusions may be utilized, it is preferred that the rear portion 82 have twice as many as the front portion 84 and are smaller in physical size and length of projection. In both cases, the protrusions 88 simply add flexibility and resiliency to the discs outer edge which is particularly useful in the event the cleaner strikes an obstruction or some large foreign object.

Figure 7:
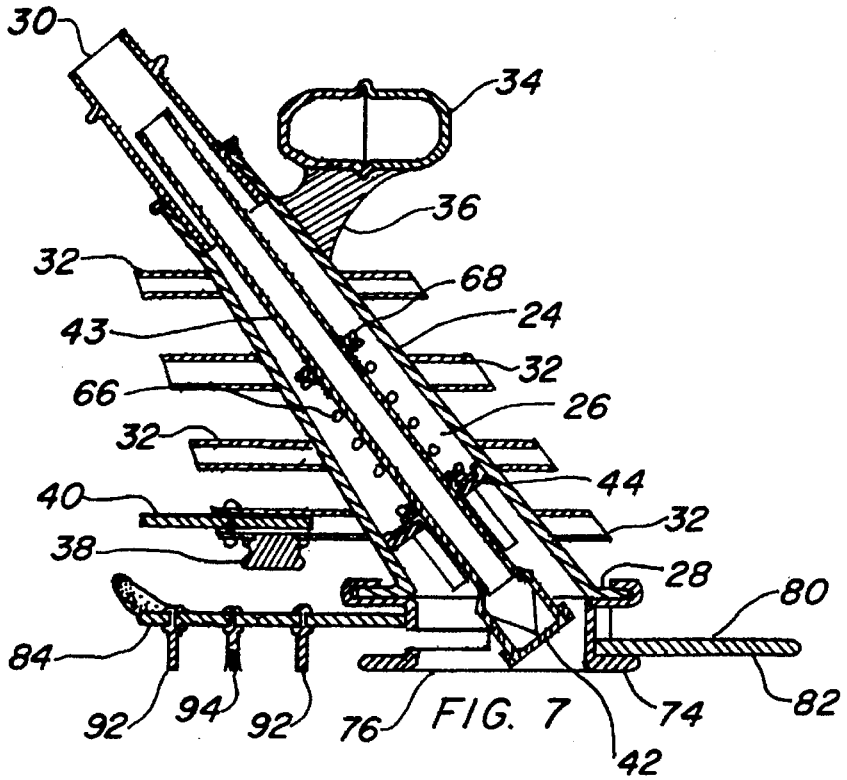
FIG. 7 is a cross-sectional view taken along lines 7—7 of FIG. 1.
Figure 8:
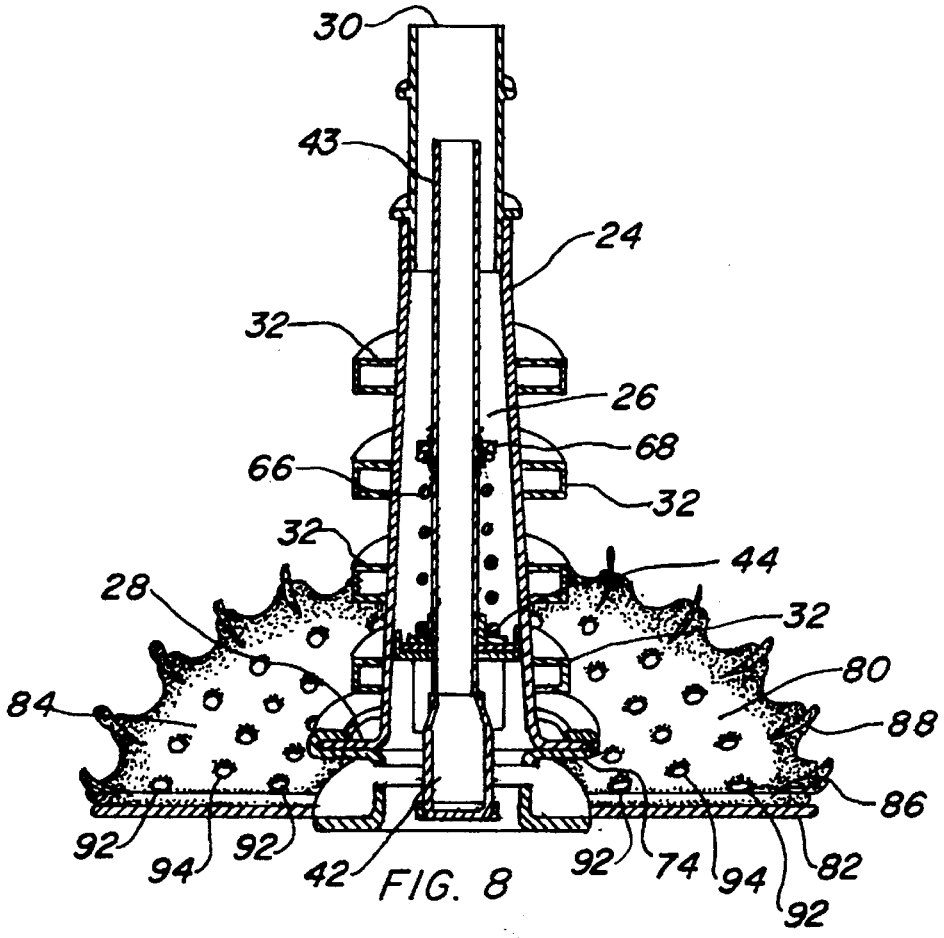
FIG. 8 is a cross-sectional view taken along lines 8—8 of FIG. 1.
Figure 22:
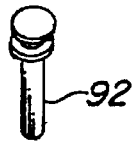
FIG. 22 is a partial isometric view of the scraper completely removed from the invention for clarity.
Figure 23:
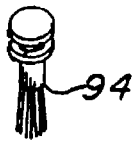
FIG. 23 is a partial isometric view of the brush completely removed from the invention for clarity.

In order to enhance the cleaner's ability to scrub the pool's submerged surface, a plurality of downwardly projecting spacing scrapers 92 and brushes 94 are added to the bottom of the raised front portion 84 of the flexible circular disc 80. FIGS. 1 and 7 depict this arrangement and FIGS. 22 and 23 illustrate an individual scraper 92 and brush 94 completely removed from the disc 80. The scrapers 92 extend downward and away from the raised front portion 84, parallel with the flat rear portion 82, and the brushes 94 are of a length as to intersect with the pool surface in a compressive manner, as they are positioned between the scrapers 92. This arrangement dislodges debris clinging to the pool surface for ingestion into the cleaner.

The flexible circular debris removing disc 80 releasibly engages the pool surfaces in conjunction with the inlet mounting foot 74, as influenced by the suction of the water flow created by the pool pump intake. Propulsion of the cleaner is accomplished by the pump's negative pressure, holding the device tightly against the pool surface momentarily and is then released due to the cyclic pulsations generated by the integrated reed valve 42 and relief valve 44. As previously described, this pulsation in the form of a physical shock wave within the water flow, permits the cleaner to move in a random fashion upon the submerged bottom and walls of a pool continuously. The combination of the flexible circular disc 80 with it's protrusions 88, scrapers 92, brushes 94, and offset 86, as well as the grooves 78 in the mounting foot 74, cause debris to be swept by turbulent water flow across the disc raised portion 84 and into the pool's filtration system through the suction side of the pool pump. While the high velocity water flow and negative pressure hold the pool cleaner tightly against the surface of the pool, the extracted water has an abrasive effect on the surface which accomplishes the cleaning effect desired for the apparatus.

It may also be seen that this cleaning action is highly efficient, as the complete flow of water is always present in the entire system contrary to prior arts approach. While the actual reed valve 42 closure momentarily shuts off flow at the valve, the resiliency of the hose connecting the cleaner to the pool pump allows a slight decrease in diameter throughout it's entire length. This action overcomes full shut off and, yet, allows the cyclic pulsations to be generated for mobility while still permitting the pump to see maximum flow at all times.

Figure 2:
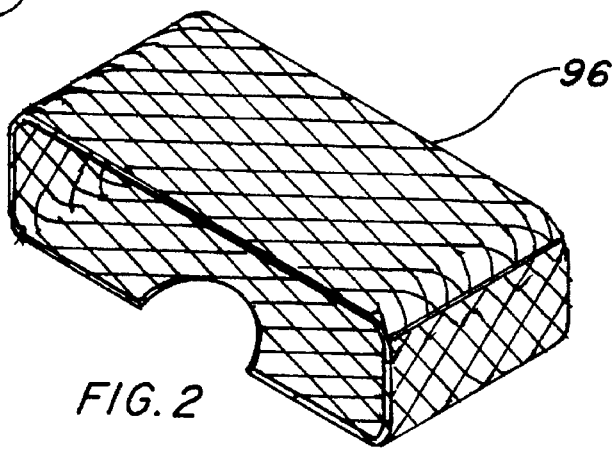
FIG. 2 is a partial isometric view of the leaf net completely removed from the invention for clarity.
Figure 4:
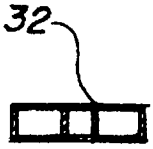
FIG. 4 is a cross-sectional view taken along lines 4—4 of FIG. 1 illustrating the construction of a typical bumper.
Figure 5:
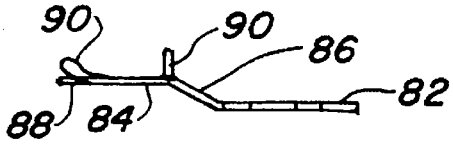
FIG. 5 is a left side view of the preferred embodiment illustrating only the edge of the debris collecting disc.
Figure 6:
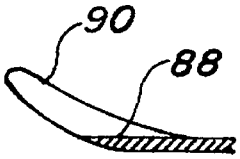
FIG. 6 is a cross-sectional view taken along lines 6—6 of FIG. 1 illustrating a fin on the edge of the disc.

A leaf catching net 96, as shown by itself in FIG. 2, may be optionally attached in a removable manner to the hollow body 24 for collecting large debris from the pool surface, as the cleaner progresses forward by it's hydraulic cyclic pulsation.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. A pulsating submergible pool cleaner for cleansing submerged surfaces of a swimming pool utilizing water flow from a pool filtration pump comprising;

a hollow body having a water flow passageway therethrough, connected to a pool pump with a flexible hose, full flow valve means disposed entirely within the hollow body water flow passageway receiving complete flow of water from the pool filtration pump, closing and shutting off water flow from the pump suction side subsequently generating an immediate opening of a relief portion of the valve means to maintain unimpeded flow effectively producing a hydraulic cyclic pulsation action from the valve means operation, and debris removing disc means detachably mounted onto the hollow body, releasably engaging pool surfaces influenced by suction created by the pump and propelled in a random manner by cyclic pulsations generated by the valve means, drawing debris from under the disc means into a pool filtering system through the filtration pump.

2. The pool cleaner as recited in claim 1 wherein said hollow body further comprises a top and a bottom with an outlet on the top and an attaching flange having an inlet on the bottom, said body further having a plurality of bumpers protruding in a planar alignment with the disc means for preventing upward movement of the body when striking an obstacle within a pool.

3. The pool cleaner as recited in claim 1 wherein said full flow valve means further comprise a combined, double acting reed valve and a spring loaded relief valve.

4. The pool cleaner as recited in claim 1 further comprising an inlet mounting foot attachably disposed between the body and the debris removing disc means providing a flat surface for engaging submerged walls and bottom of a swimming pool and for joining the body to the disc means in a removable manner.

5. The pool cleaner as recited in claim 1 wherein said debris removing disc means further comprise a flat rear portion and a raised front portion with an offset inbetween allowing debris to be swept from pool walls and bottom by turbulent water flow across the raised portion also holding the pool cleaner tightly against submerged surfaces of a pool with negative pressure created by the filtration pump extracting water from beneath the disc means.

6. A pulsating submergible pool cleaner for cleansing submerged surfaces of a swimming pool utilizing water flow from a pool filtration pump comprising;

a hollow body having a water flow passageway therethrough, a bottom flange with an inlet therein and a top outlet removably attached to a pool pump with a flexible hose, an integrated full flow reed valve with a full flow relief valve disposed entirely within the hollow body water passageway respectively receiving an entire flow of water from the pool filtration pump, the reed valve closing by negative pressure deflecting reeds into contiguous engagement subsequently generating an immediate opening of the relief valve to maintain a continuous unimpeded water flow effectively producing a hydraulic cyclic pulsation action within the pump flow stream by sequential opening and closing of each valve, an inlet mounting foot attachably disposed beneath the hollow body providing a flat surface for engaging submerged surfaces of a swimming pool and for joining the body to a disc in a removable manner, and a flexible circular debris removing disc detachably mounted onto the hollow body, releasably engaging pool surfaces influenced by suction created by the pump and propelled in a random manner by cyclic pulsation generated by the integrated valves drawing debris from under the circular disc into a pool filtering system through the filtration pump.

7. The pool cleaner as recited in claim 6 further comprising leaf catching means removably attached to the hollow body for collecting large debris from a pool surface as the cleaner progresses thereupon.

8. The pool cleaner as recited in claim 6 wherein said hollow body further comprises a plurality of bumpers protruding in a planar alignment with the disc preventing upward movement of the body when striking an obstacle within a pool.

9. The pool cleaner as recited in claim 6 further wherein said reed valve includes a pair of opposed double acting reeds and said relief valve is spring loaded.

10. The pool cleaner as recited in claim 6 wherein said mounting foot further contains a plurality of outwardly extending grooves opposed but planar to the body bottom flange inlet providing sufficient cross-sectional area to prevent the cleaner from becoming inoperatively attached to a pool surface.

11. The pool cleaner as recited in claim 6 wherein said debris removing disc further comprise a flat rear portion and a raised front portion with an offset inbetween allowing debris to be swept from pool walls and bottom by turbulent water flow across the raised portion also holding the pool cleaner tightly against submerged surfaces of a pool with negative pressure created by the filtration pump extracting water from beneath the disc.

12. A pulsating submergible pool cleaner for cleansing submerged surfaces of a swimming pool utilizing water flow from a pool filtration pump comprising;

a hollow flanged body having a water flow passageway therethrough, a bottom flange with an inlet therein, a top outlet removably attached to the pool pump with a flexible hose and a plurality of peripheral bumpers distending outwardly from the body for stability, an integrated full flow double acting reed valve with a full flow spring loaded relief valve disposed entirely within the hollow body water passageway respectively receiving an entire flow of water from the pool filtration pump, the reed valve closing by negative pressure deflecting the double acting reeds into contiguous engagement subsequently generating an immediate opening of the relief valve to maintain a continuous unimpeded water flow effectively producing a hydraulic cyclic pulsation action within the pump flow stream by sequential opening and closing of each valve, an inlet mounting foot with grooves attachably disposed beneath the hollow body providing a flat surface for engaging submerged surfaces of a swimming pool and for joining the body to a disc in a removable manner, and a flexible circular debris removing disc having a flat rear portion and a raised front portion with an offset inbetween detachably mounted onto the hollow body, releasably engaging pool surfaces influenced by suction created by the pump and propelled in a random manner by cyclic pulsations generated by the integrated valves allowing debris to be swept from a pool surface by turbulent water flow across the disc raised portion and into a pool filtration system also holding the pool cleaner tightly against the surface of the pool with negative pressure created by the filtration pump extracting water from beneath the disc.

13. The pool cleaner as recited in claim 12 further comprising a leaf catching net removably attached to the hollow body for collecting large debris from a pool surface as the cleaner progresses forward by hydraulic cyclic pulsation.

14. The pool cleaner as recited in claim 12 wherein said peripheral bumpers are hollow and of an extended length beyond the body exterior front and back providing both directive characteristics and water flow passages for stability.

15. The pool cleaner as recited in claim 12 further comprising a float attached proximal with the body outlet to provide automatic uprighting in the event the cleaner turns upside down.

16. The pool cleaner as recited in claim 12 further comprising a weight attached beneath a lowest bumper to provide stability for the cleaner when the cleaner is propelled on pool submerged surfaces.

17. The pool cleaner as recited in claim 12 further comprising a bumper wheel rotatably disposed within a lowest forward bumper and extending therefrom for continued mobility if the cleaner hits fixed obstructions.

18. The pool cleaner as recited in claim 12 wherein said double acting reed valve further comprises a pair of opposed double acting reed assemblies each having both a fixed reed and a movable reed, the movable reed includes a first end and a second end with the fixed reed attached to a rigid member of the valve on one end and to the second end of the movable reed on another, with the movable reed disposed over a fulcrum on a rigid member of the valve such that when negative pressure introduced onto the valve first end, the movable reed deforms yielding at the fulcrum also bending the second end along with the remaining fixed reed simultaneously in a double spring action, the opposed pair form a closure when each first end contiguously abut.

19. The pool cleaner as recited in claim 12 wherein said spring loaded relief valve further comprises a valve seat integral with the integrated valve, a seal disc in linear alignment with the seat and a compression spring urging the seal disc against the seat such that when negative pressure occurs on the seal disc the seal disc is pulled against spring pressure into an open position relieving seal disc flow blockage, thus permitting water flow through the valve.

20. The pool cleaner as recited in claim 12 wherein said debris removing disc further comprises a plurality of spacers and brushes distending from the raised front portion extending parallel with the flat rear portion such that debris clinging to a pool surface is dislodged for ingestion into the cleaner.

* * * * *